United States Patent [19]

Babunovic

[11] 3,938,532

[45] Feb. 17, 1976

[54] CONTAINER CLEANING APPARATUS

[75] Inventor: Momir Babunovic, Des Peres, Mo.

[73] Assignee: Barry-Wehmiller Company, St. Louis, Mo.

[22] Filed: Feb. 10, 1975

[21] Appl. No.: 548,538

[52] U.S. Cl. ..... 134/43; 134/126; 134/129; 134/152; 198/19

[51] Int. Cl.[2] ..... B08B 3/02

[58] Field of Search ..... 134/129, 43, 125–126, 134/131, 152; 198/19

[56] References Cited

UNITED STATES PATENTS

| | | | |
|---|---|---|---|
| 2,607,361 | 8/1952 | Gerlach | 134/129 |
| 2,655,928 | 10/1953 | Herold | 134/126 X |
| 3,111,131 | 11/1963 | Nekola et al. | 134/129 |
| 3,129,713 | 4/1964 | Read | 134/129 X |

*Primary Examiner*—Robert L. Bleutge
*Attorney, Agent, or Firm*—Gravely, Lieder & Woodruff

[57] ABSTRACT

Apparatus for cleaning containers such as bottles for reuse in which the bottles are placed in carriers for movement along a horizontally directed path comprising means operably supporting the carriers for concurrent movement in a vertical path, and jets of cleaning fluid which follow a generally horizontal path and move from a starting position aligned with the bottles while the carriers with the bottles are in a vertically lowered position and return to the starting position while the carriers move the bottles upwardly in the vertical path. The apparatus includes means to coordinate the motions set out above and means to assure proper alignment of jets and bottles.

10 Claims, 8 Drawing Figures

CONTAINER CLEANING APPARATUS

BACKGROUND OF THE INVENTION

This invention pertains to improvements in container cleaning apparatus, and for convenience will refer to bottles that require cleaning prior to reuse or bottles being introduced for the first time to usage.

In the prior patent of Nekola et al. U.S. Pat. No. 3,111,131 granted Nov. 19, 1963 there has been disclosed fluid injecting means for cleaning bottles where the bottles are confined to move along a fixed path while the spray injection means is caused to move periodically toward and away from the bottles, as well as with and reverse to the bottle movement. The apparatus is subject to excessive wear and the motions required develop erratic and jerky responses so the cleaning results are not assured. The prior apparatus was arranged such that heavy masses were required to be moved with two distinct cyclic motions that introduced wear on the mechanism needed to produce the motions. It is also disclosed in said prior patent that the fluid supply arrived in hoses that had to be flexible and were subjected to the hostile enviroment of the rinsing fluid and compound movements and had a short service life.

It is, therefore, a principal object of this invention to provide apparatus that avoids the motion problems referred to and can operate at greater speed to yield a higher throughput per unit of time.

It is a further object to provide jet spray arrays for multiple bottle jetting with means to limit the motion of the the spray to one that is generally horizontally cyclic, and to employ a continually moving drive for the bottle carriers with sufficient looseness or slack in the area of the jet sprays such that the carriers are movable in a vertically oscillating cycle while advancing in regular order.

Another object of this invention is to provide common drive means for obtaining proper coordination between the horizontal cyclic motion of jet spray means with vertical cyclic motion of the carrier for the bottles to be jet cleaned and to incorporate counterbalancing means capable of storing energy at times during the vertical cyclic motion of the heavy assembly for moving the carriers.

A further object of this invention is to avoid the use of large lengths of flexible conduit and to minimize the replacement problem attendant upon conduits that deteriorate easily.

In a preferred embodiment the apparatus comprises a bottle carrier movable generally horizontally through a spray cleaning zone on supporting means that is adapted to move vertically for raising and lowering the carrier, a fluid spray means movable along a horizontal path in a forward and reverse cycle, and means to drive both the carrier in its vertical motion and the spray means in the horizontal path such that the carrier is enabled to move continuously through the cleaning zone. The apparatus includes means to assure alignment of the bottles and spray means, and counterbalancing means for absorbing the load of the means for lowering the carrier.

BRIEF DESCRIPTION OF THE DRAWINGS

A presently preferred embodiment of the container cleaning apparatus is shown in connection with an organization of components, wherein.

DETAILED DESCRIPTION OF THE EMBODIMENTS

Figure 1:
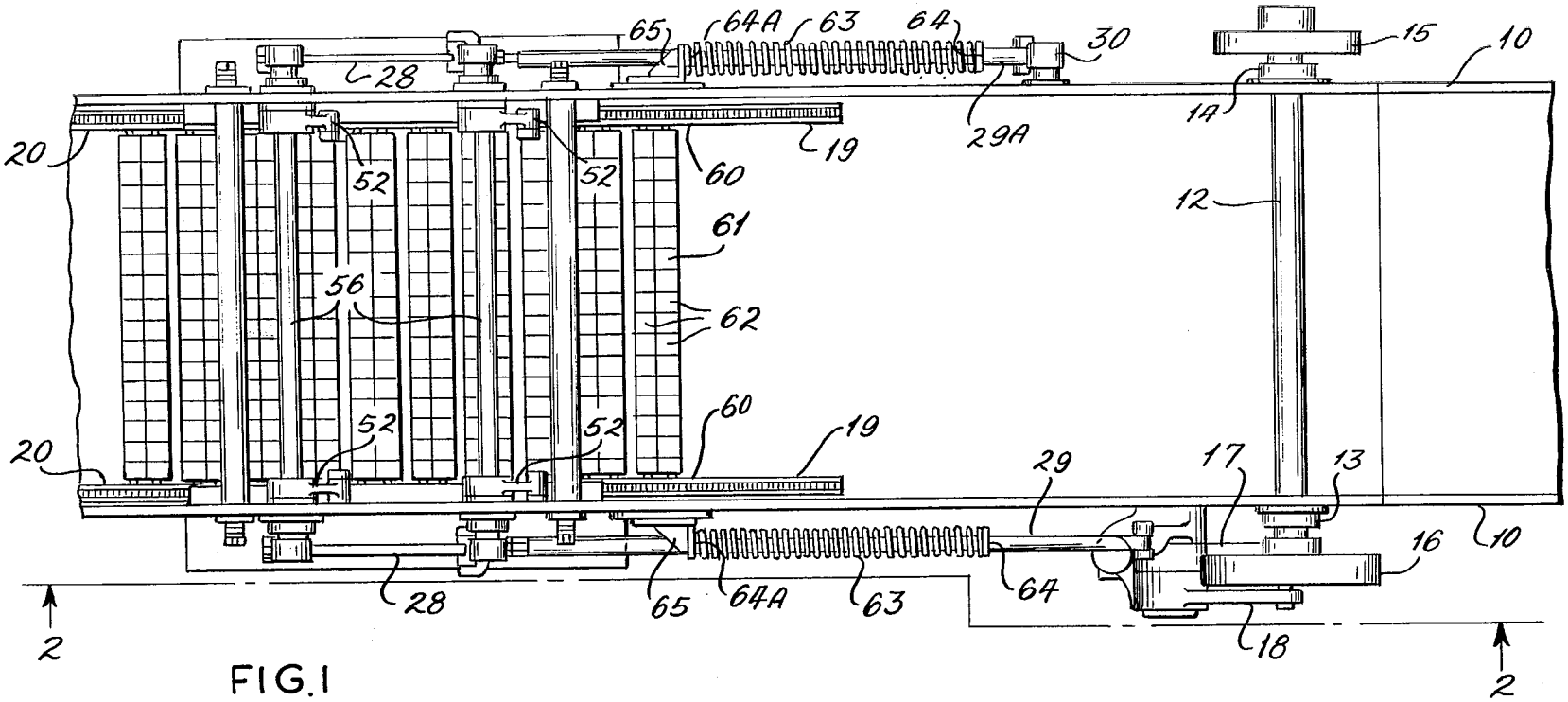
FIG. 1 is a fragmentary plan view of a portion of a machine in which the general arrangement of components may be seen.
Figure 2:
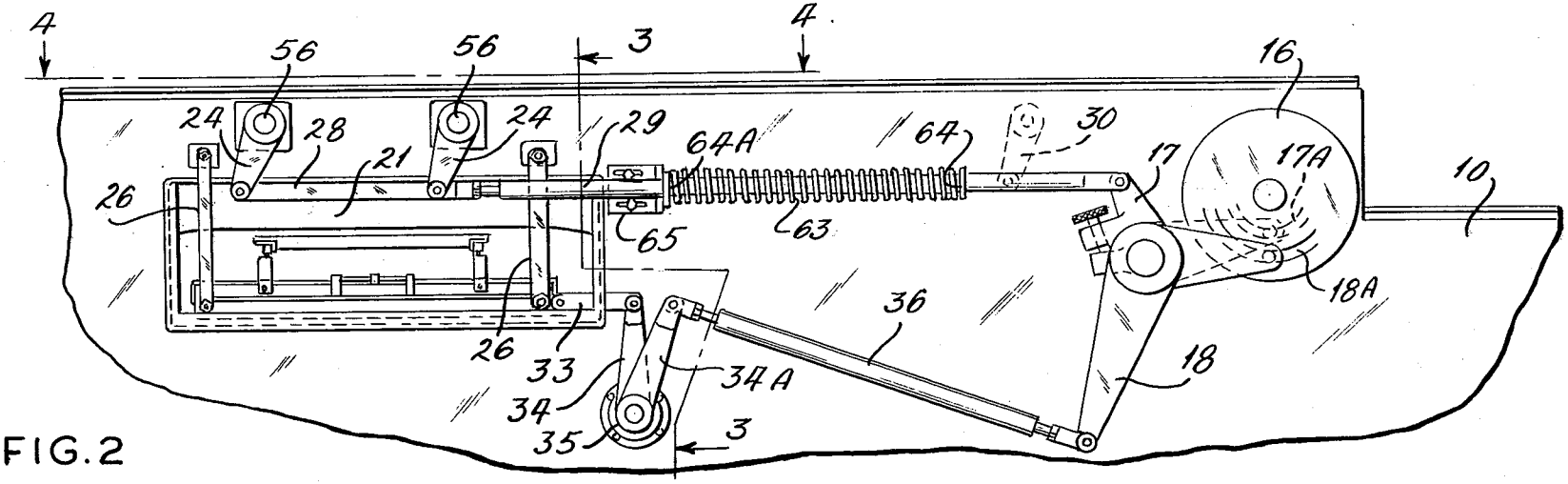
FIG. 2 is a view of the apparatus as seen in elevation along line 2—2 in FIG. 1.

FIGS. 1 and 2 are general views of that portion of the bottle cleaning apparatus in which the arrangement of components is shown in plan and side elevation. The apparatus is mounted on and between the opposite side walls 10 of the container rinsing fluid containing tank. A drive shaft 12 is carried by suitable bearings 13 and 14 secured to the respective tank walls 10. The element 15 delivers the power for operating mechanism to be described. The shaft at bearing 13 carries a double groove cam 16 for oscillating a bell crank 17 at the inside cam face and a bell crank 18 at the outside cam face. There is also shown generally in FIG. 1 the location of the large diameter sprocket wheels 19 and 20 arranged in opposed pairs and carried by bearings attached to the side walls 10. These sprockets carry and drive roller chains to be set forth presently.

Figure 3:
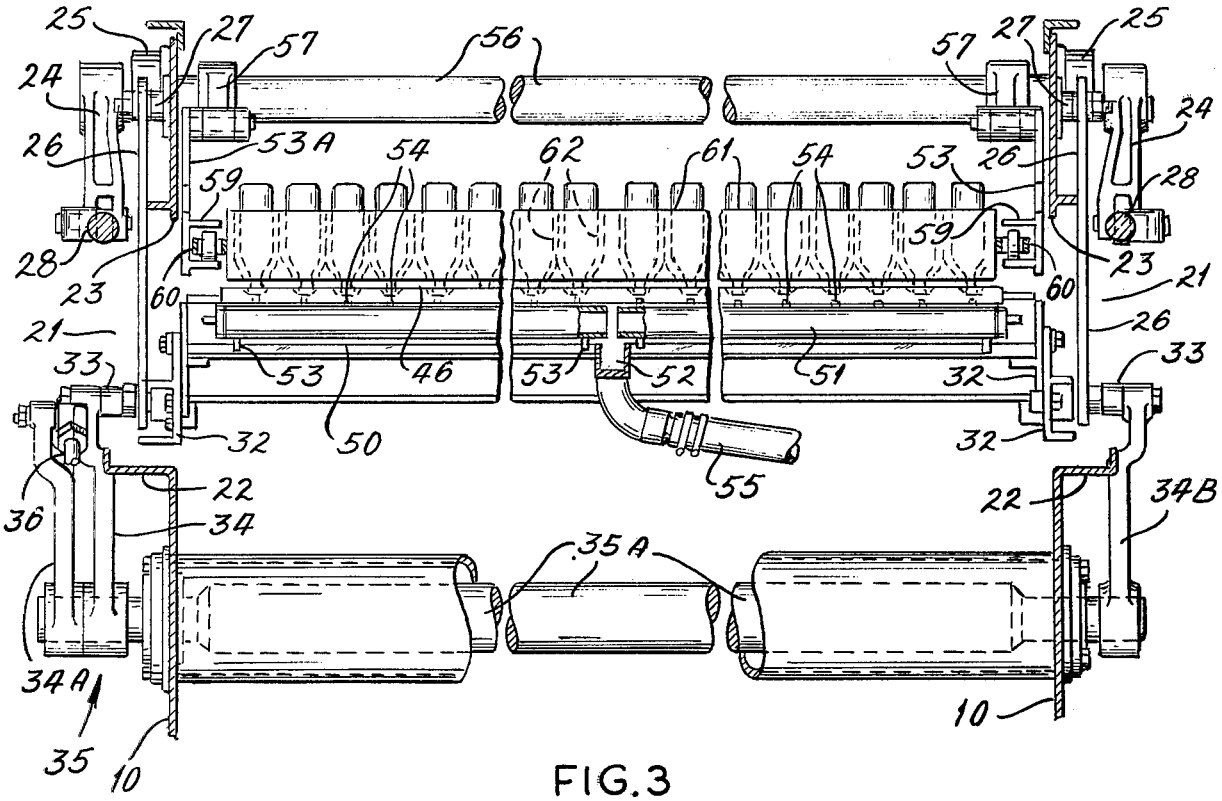
FIG. 3 is a fragmentary section view of the apparatus seen along line 3—3 in FIG. 2.
Figure 6:
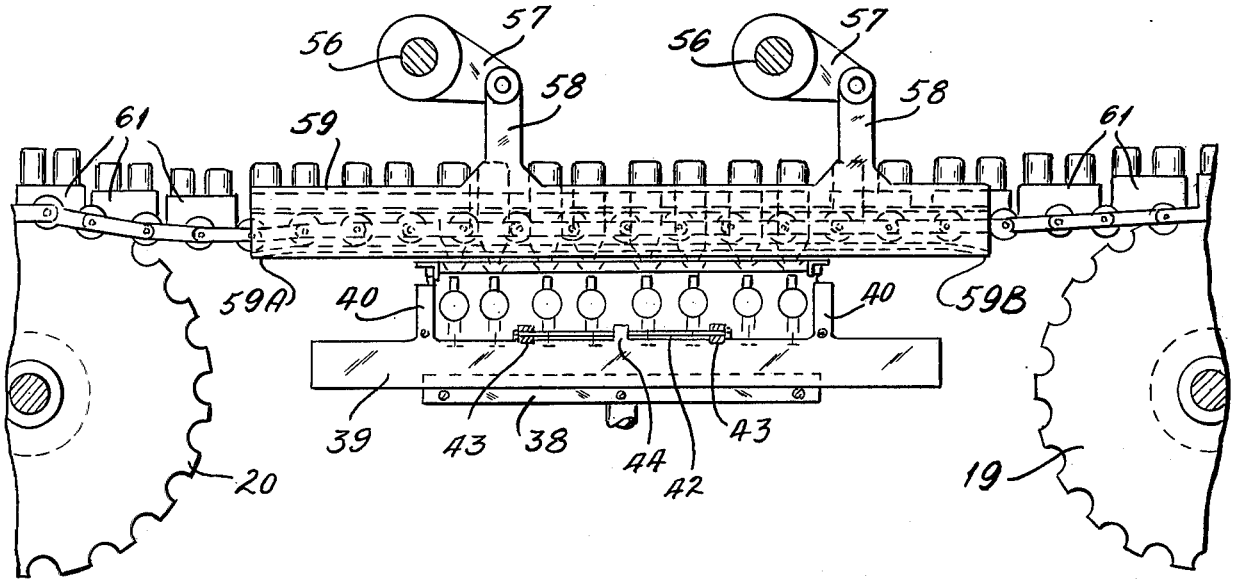
FIG. 6 is a view taken along line 6—6 in FIG. 4.

Comparing FIGS. 2 and 3, it can be seen that each side wall 10 is formed with a window opening 21 having a sill flange 22 and an upper edge 23. The window 21 is located where observation of and adjustments may be made on the mechanism operatively disposed in the tank but responsive to external mechanism which consists of the following components. A pair of first cranks 24 are carried by bearings 25 (FIG. 3). These cranks and necessary bearings have duplicate parts on the opposite tank wall 10. A pair of idler links 26 are suspended from pivots 27 on side wall 10, and duplicate idler links 26 and pivots 27 are disposed on the opposite wall 10. The lower ends of the idler links 26 on both sides of the tank are aligned with each other and are located within the margins of the windows 21 in walls 10.

The first cranks 24 at wall 10 are interconnected by link 28 at the lower or free ends thereof, and the right hand crank 24 also has its free end connected to a drive link 29 which extends to and is connected with the inner bell crank 17. The first cranks 24 at opposite wall 10 are also interconnected by a link 28, and the right hand crank is also connected to one end of an idler link 29A. The opposite end of idler link 29A is connected to a free swinging arm 30 supported on wall 10. It can be seen that the cranks 24, links 28 and links 29 and 29A constitute a substantially symmetrical system movable upon power input to the cam 16 and to the bell crank 17. This system of cranks 24 and the drive therefor will be related to other mechanism presently.

Referring to FIGS. 2, 3, 7 and 8, it is seen that the idler links 26 adjacent the left hand side wall 10 are connected through pivots 31 to a longitudinal beam 32 so that the beam 32 is suspended from its opposite ends within the tank but in view of the window 21. The idler links 26 at the opposite wall 10 are connected in like manner to a similar beam 32. The near side idler link (FIG. 2) at wall 10 is connected to a link 33, and this link is connected to one arm 34 of a swing member 35 and the other arm 34A of the swing member is connected to the cam operated bell crank 18 by a link 36. Thus, the same cam 16 furnishes the drive to link 29 and to link 36. The swing member 35 is fixed to a torque shaft 35A (FIG. 3) which extends to the opposite wall 10 to carry an arm 34B which like arms 34 is connected by link 33 to the beam 32 at that side.

In FIGS. 3, 5, 6, 7 and 8 it can be seen that the respective beams 32 inside windows 21 in walls 10 support a superstructure which is made up as follows: each beam 32 carries a track 38 which is engaged by the lower edge of a plate 39. This plate is formed with extensions 40 projecting above the upper edge at spaced locations, and clips 41 are located at each extension to engage the plate and retain it on the beam. When the clips 41 and track 38 are loosened the plate 39 can be slid along the beam 32 in either direction by means of a threaded shaft 42 turning in place in end supports 43 and running through a nut 44 fixed on the plate 39. The extensions 40 support suitable rollers 45 for supporting angle iron runners 46 of a tray 47 of bottle alignment cups 48. The tray 47 may be rolled out through the window 21 like a drawer when needed.

Figure 7:
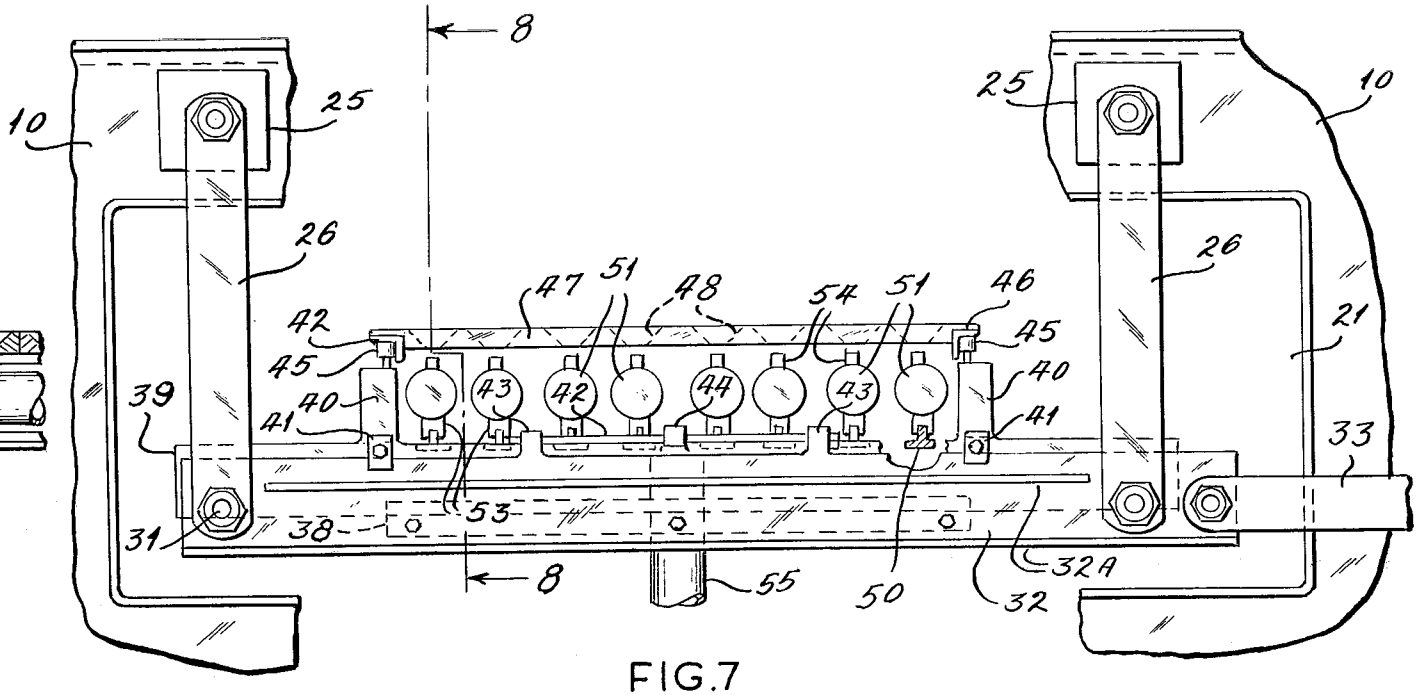
FIG. 7 is a greatly enlarged and fragmentary view of the components previously seen in FIG. 5.
Figure 8:
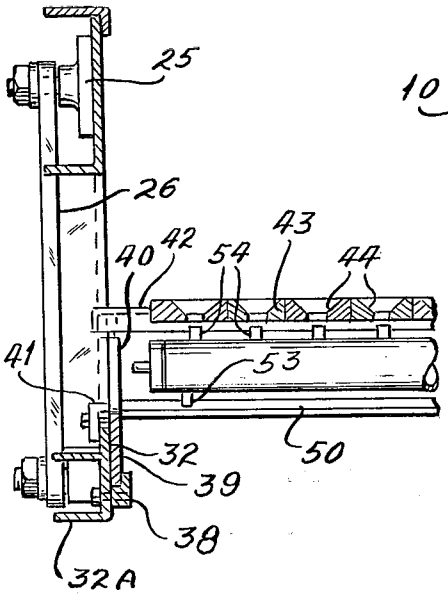
FIG. 8 is a sectional view taken along line 8—8 in FIG. 7.

The plates 39 support a series of rails 50 directed across the width of the apparatus and spaced apart so as to underlie each row of alignment cups 48. These rails 50 support fluid carrying pipes 51 at the inner ends thereof (FIG. 3) adjacent a fluid supply manifold 52. Each pipe 51 is provided with spaced notched tabs 53 fixed in position and directed with the notchs engaged on the rails 50 (FIG. 7). This manner of supporting the pipes 51 will assure proper alignment of the series of nozzles 54 spaced along the upper side of the pipes 51 with the cups 48. Fluid is supplied to the nozzles 54 through the manifold 52 from a main supply hose 55 which is flexible to accommodate the reciprocating motion of the assembly supported from the idler links 26.

Figure 5:
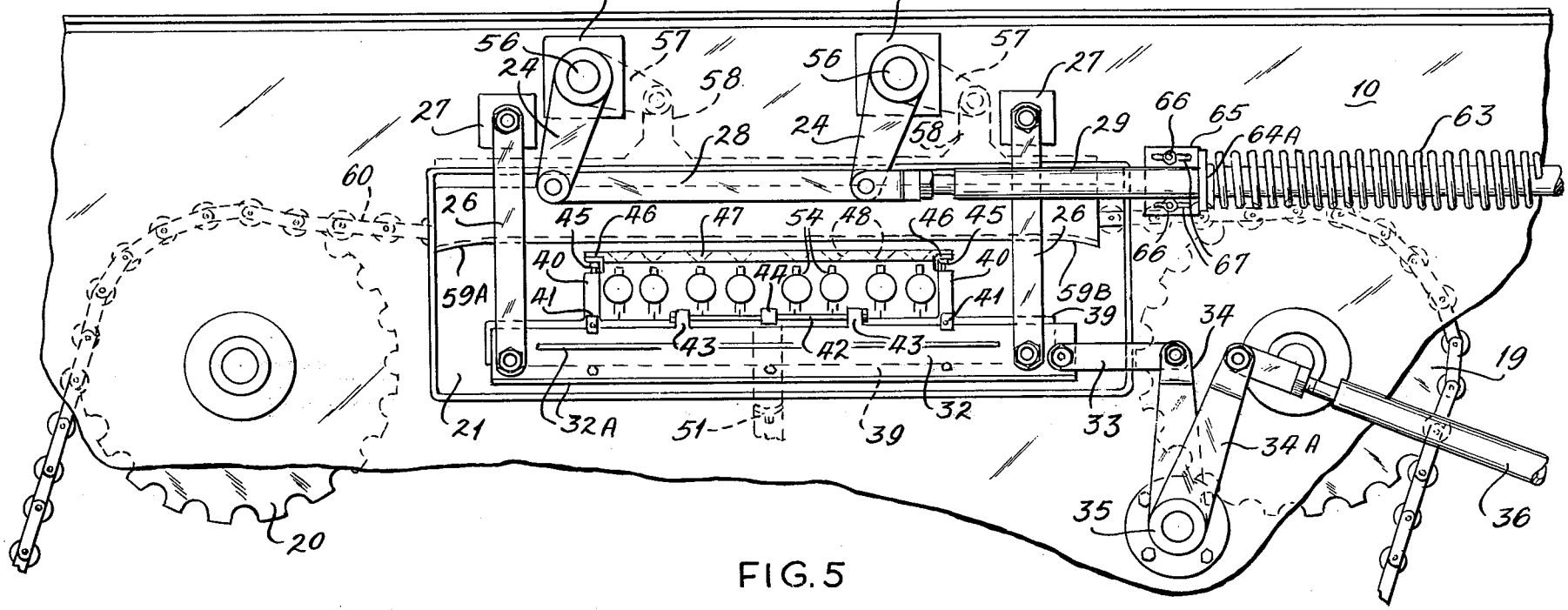
FIG. 5 is a view taken along line 5—5 in FIG. 4.

In FIGS. 3 and 5 it can be seen that the external or first cranks 24 are connected to shafts 56 which extend across the inside of the tank between walls 10. Each shaft 56 carries a pair of second crank arms 57 (FIG. 6), the arms 57 being disposed adjacent the walls 10. These second crank arms 57 are interconnected by arms 58 on roller chain supporting tracks 59. The supporting track 59 at each wall 10 has shaped lead-in and lead-out ends, respectively seen at 59A and 59B for a purpose to appear.

Figure 4:
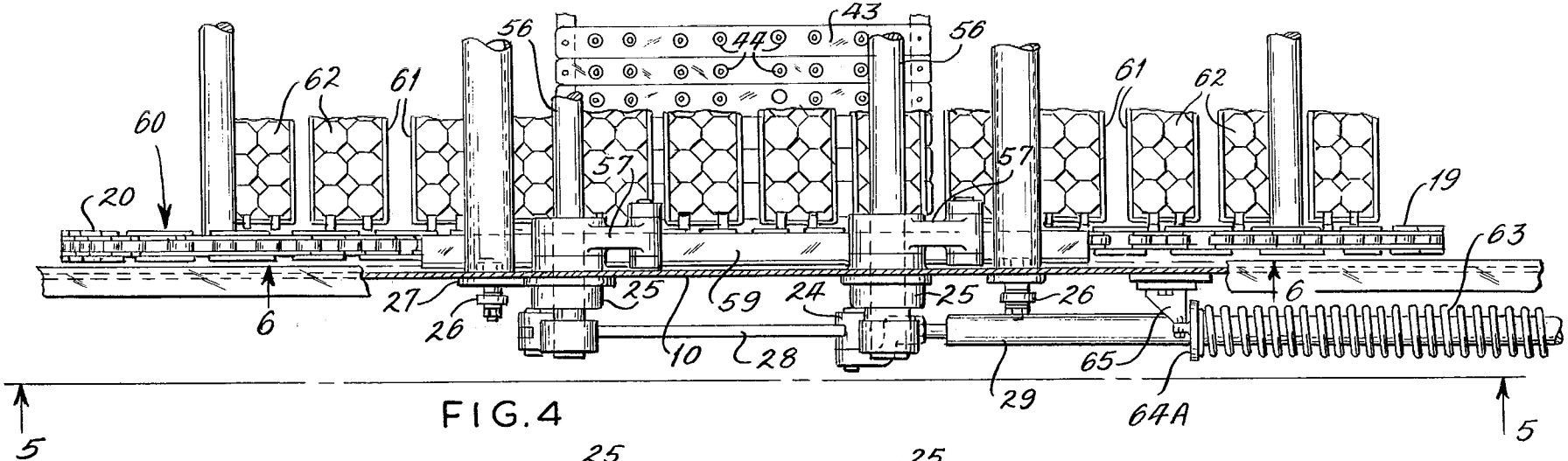
FIG. 4 is an enlarged plan view of a portion only of the components previously shown in FIG. 1.

Looking now at FIGS. 1, 4 and 5, the tank walls 10 carry sprocket wheels 19 and 20 arranged in pairs and located beyond the lead-out and lead-in ends 59B and 59A of the tracks 59 which support the roller chain 60 carrying the bottle carriers 61 arranged with tandem pockets for the bottles. The sprockets 19 and 20 are spaced a sufficient distance so that the span of the roller chains 60 between them will have freedom to move vertically. Both pairs of sprockets 19 and 20 are driven by a power source in the apparatus not thought necessary to show.

OPERATION OF THE EMBODIMENTS

With reference to FIGS. 4 and 5, the roller chains 60 are trained over the sprockets 20 and 19 in order of travel from left to right. As the chains leave sprockets 20 they enter the shaped lead-in ends 59A of the tracks 59 and exit at the shaped lead-out ends 59B on the way to sprocket 19. These chains 60 are connected to bottle carriers 61 wherein tandem aligned pockets 62 are provided to support the bottles or containers with the open mouth oriented downwardly. While the tracks 59 are open at the side to pass the carriers 61, the path of the carriers is fixed by the track position. However, the tracks 59 are suspended by drop links 58 (FIG. 6) from the overhead crank arms 57 located inside the tank, and these interior crank arms are in turn connected through shafts 56 to the external cranks 24. In the view of FIGS. 1 and 5, horizontal displacement of the drive link 29 and the idler link 29A will cause the cranks 24 to move about the axis of shafts 56 and this motion causes the internal crank arms 57 to move the roller chain tracks 59 in a vertical direction. The vertical motion of tracks 59 is not interfered with due to the slack in the roller chains 60 between the driven sprockets 19 and 20. Thus, the carriers 61 and the load of bottles in the pockets 62 will be caused to rise and fall with the oscillatory motion of the cranks 24. The oscillatory motion is obtained through the bell crank 17 following the contour of the cam groove 17A (only partly shown) in the cam 16. The bell crank 17 imparts its movement to the link 29, and while link 29 is being driven the opposite idler link 29A is performing the same movement.

In apparatus of this character the size of the carriers 61 and the full complement of bottles can weigh as much as several tons. The vertical motion imparted to this mass through the crank and link system described can impart significant stress on the structure and shock to bearings. Therefore, there is provided means to counterbalance the load in the form of energy springs 63 on each of the links 29 and 29A. The details of the spring 63 on link 29 will suffice for both, and in FIGS. 1 and 5 the link 29 carries an abutment 64 for one end of the spring. The opposite end of spring 63 engages an abutment plate 64A which is secured to a bracket 65 adjustably connected to the wall 10 by bolts 66 extending through slots 67. The link 29 is free to move through the plate 64 toward the right as the link 29 raises the mass of the carriers 61 and the load of bottles, and the springs 63 give aid to this by pushing on the abutments 64 fixed on the links 29 and 29A. When, however, the links 29 move to lower the carriers 61 and bottles the springs 63 check the fall of this mass and act to counterbalance the weight. The adjustment provided by the bracket 65 gives the springs 63 a range of counterbalancing effect.

While the cam groove 17A and crank 17 determines the vertical oscillations of the bottle carriers 61 aligned with the tracks 59, the cam groove 18A and crank 18, through link 36, swing means 35 and link 33, cause the idler links 26 to swing the beams 32 in a generally horizontal path of oscillatory movement. The length of the idler links 26, and the stroke of the bell crank 18 is chosen so that it will limit the tendency of the beams 32 to rise significantly on either side of a vertically pendent position of the idler links 26. Thus, the array of spray nozzles 54 and supply pipes 51, as well as the tray of cups 48, will move in a generally horizontal path and oscillate through a stroke that is made to match the width of either two or four rows of pockets 62. For instance with a two-row stroke, the array of nozzles and cups are moved rightwardly (FIG. 5) a distance of one carrier width as measured between centers of the pockets 62 in the two rows, and then they are returned to the starting position and move rightwardly again the same distance for the next carrier. In the example shown in FIG. 5 there are rows of nozzles 54 for jetting bottles carried in four tandem carriers 61 which is eight rows of bottles. The supply of fluid at hose 55 may be continuous or intermittent.

When the motions of the bell cranks 17 and 18 are properly timed by the cam 16 the carriers 61 will be lowered down to the array of the nozzles 54 and cause the bottles to engage in the cups 48 so as to positively align the mouth of each bottle over a nozzle. The distance travelled during the lowering of the carriers 61 is sufficient to cause the mouth of the bottles to engage and be supported by the cups 48 so that there is transfer of the weight of the bottles to assure positive alignment. If the cups 48 do not at first line up properly the threaded adjusting screw 42 (FIG. 5) may be rotated as required to shift the entire array of nozzles 54 and cups 48 relative to the supporting beams 32 after which the clips 41 can be tightened to retain the adjustment. The forward travel of the nozzles 54 is timed to match the forward travel of the carriers 61, and the vertical motion of the tracks 59 is sufficient to momentarily transfer the weight of the bottles (not the carriers) on to the cups 48, thereby assuring proper alignment of the bottles over the jet spray nozzles 54.

The foregoing description relates to a presently preferred embodiment and one that is regarded to be most desirable. However, it is stressed that the principles of the coordinated motions of the means to cause the travel of the nozzles with the rise and fall of the bottle carriers may be incorporated in embodiments that represent modifications of the described structure.

What is claimed is:

1. Container cleaning apparatus comprising a plurality of pocketed carriers for the containers to be cleaned, conveying means to move said carriers continuously through the apparatus, means defining a linear path of movement for said conveying means, fluid jet spray means adjacent said linear path, movable means operably supporting said spray means for forward and reverse movement in a generally horizontal path, drive means operably connected to said movable means to effect the forward and reverse movement of said spray means, and an operating connection between said drive means and said linear path defining means for periodically raising and lowering said carriers, said drive means and operating connection coordinating said forward movement of said spray means with lowering of said carriers and reverse movement of said spray means with raising of said carriers.

2. The apparatus of claim 1 wherein said conveying means is a chain, said linear path defining means is engaged by said chain to guide said carriers, and said operating connection between said drive means and said linear path defining means includes crank means having first arms movable horizontally and second arms movable vertically.

3. The apparatus of claim 1 and including means for centering the containers in said pocketed carriers with said fluid jet spray means, said centering means acting upon the lowering of said carrier and the forward movement of said spray means supporting means to engage the mouth of the containers.

4. The apparatus of claim 1 and including counterbalancing means operably engaged with said operating connection for raising and lowering said carriers, said counterbalancing means being effective on lowering operation of said carriers to absorb the weight thereof and assist in the raising thereof.

5. The apparatus of claim 1 and including means operable between said fluid jet spray means and said movable supporting means therefor for shifting the fluid jet spray means to obtain alignment with the pockets of said pocketed carriers.

6. Container cleaning apparatus comprising conveyor means extending through a cleaning zone of the apparatus, track means supporting said conveyor means in said zone, carriers for containers attached to said conveyor means so as to be propelled through said zone, said carriers supporting the containers in inverted positions, an array of cleaning fluid jetting nozzles disposed below the travel of said carriers through said zone, container centering means disposed above and in alignment with each of the nozzles in said array, support means for said nozzles and centering means, means to continuously move said conveyor means through said zone for transporting said carriers loaded with containers, first operating means connected to said track means for raising and lowering the track means and said carriers and containers, second operating means connected to said support for said nozzles and centering means for movement in directions with and reverse to the conveyor movement, drive means operably coordinating said first and second operating means for effecting the lowering of said track means with the forward movement of said support to bringing the inverted containers into said centering means to receive cleaning fluid from said jetting nozzles, and a cleaning fluid supply conduit connected to said array of nozzles.

7. The apparatus of claim 6 wherein said conveyor moving means is continuous to maintain movement of said carriers through the cleaning zone.

8. The apparatus of claim 6 wherein said first operating means includes resilient means operable upon lowering of said track means to store energy which is released to assist in the raising of said track means.

9. The apparatus of claim 6 wherein said lowering of said track means toward said support means for said nozzles and centering means effects transfer of the weight of the containers to said support means, whereby positive alignment of nozzles and containers is assured.

10. The apparatus of claim 6 wherein said conveyor means includes sprockets in spaced relation in said cleaning zone, roller chains trained over said sprockets and having slack in the span between said sprockets, and said track means engages only the slack of said roller chains so as to be able to raise and lower.

* * * * *